US005980293A

United States Patent [19]

Nagano

[11] Patent Number: 5,980,293

[45] Date of Patent: Nov. 9, 1999

[54] MECHANISM FOR ASCERTAINING FITTING CONDITION OF ELECTRICAL CONNECTOR ASSEMBLY

[75] Inventor: Toru Nagano, Shizuoka-ken, Japan

[73] Assignee: Yazaki Corporation, Tokyo, Japan

[21] Appl. No.: 08/975,981

[22] Filed: Nov. 21, 1997

[30] Foreign Application Priority Data

Nov. 25, 1996 [JP] Japan ..... 8-313230

[51] Int. Cl.[6] ..... H01R 4/54

[52] U.S. Cl. ..... 439/318; 439/315

[58] Field of Search ..... 439/306–323, 439/253, 254, 256, 257, 339, 338, 340, 359, 551, 662, 304, 838, 489, 488, 491

[56] References Cited

U.S. PATENT DOCUMENTS

| | | | |
|---|---|---|---|
| 3,901,574 | 8/1975 | Paullus et al. | 439/315 |
| 4,183,605 | 1/1980 | Arneson | 439/311 |
| 4,277,125 | 7/1981 | Ball | 439/311 |
| 4,497,530 | 2/1985 | Shannon | 439/312 |
| 4,629,272 | 12/1986 | Mattingly et al. | 439/318 |
| 5,590,228 | 12/1996 | Gibola et al. | 385/56 |

FOREIGN PATENT DOCUMENTS

| | | |
|---|---|---|
| 0 378 845 A1 | 7/1990 | European Pat. Off. . |
| 2-257581 | 10/1990 | Japan . |
| 4-123773 | 4/1992 | Japan . |
| 4-132178 | 5/1992 | Japan . |

*Primary Examiner*—Paula Bradley
*Assistant Examiner*—Ross N. Gushi
*Attorney, Agent, or Firm*—Finnegan, Henderson, Farabow, Garrett & Dunner, L.L.P.

[57] ABSTRACT

A mechanism for ascertaining whether a male connector is engaged with a female connector through a rotatable ring is provided. The mechanism includes a detection tool, an accommodating part formed on a connector housing of the male connector, and an engagement recess formed on the ring. The detection tool includes a body part, an engagement projection formed on the body part, and a strut part formed on the body part. The accommodating part has a large groove for receiving the body part of the detection tool and a small groove formed on a bottom of the large groove, for receiving the strut part of the detection tool. The engagement recess is provided for engagement with the engagement projection. When the engagement recess is brought into a position opposing the engagement projection, the detection tool can be slid in the accommodating part, so that the engagement projection engages with the engagement recess. On the contrary, when the engagement projection is not fitted into the engagement recess, the perfect fitting condition of the connectors cannot be realized.

7 Claims, 15 Drawing Sheets

MECHANISM FOR ASCERTAINING FITTING CONDITION OF ELECTRICAL CONNECTOR ASSEMBLY

BACKGROUND OF THE INVENTION

The present invention relates to a mechanism for ascertaining a fitting condition of an electrical connector assembly which comprises a male connector, a female connector and a rotatable engagement ring for assisting the engagement of the male connector with the female connector.

In general, this kind of electrical connector assembly includes the male connector having a male connector housing in form of a hollow cylinder, the female connector having a female connector housing in form of a hollow cylinder, and the engagement ring rotatably arranged on a peripheral face of the male connector housing. The female connector is provided, at a front end of the female connector housing, with a swelling hood for receiving the male connector. Normally, the ring has a pair of projecting studs formed on an inner periphery of a front end portion of the ring. While, the female connector is provided, on an outer periphery of the hood, with double-start threads for engagement with the studs. Note, the so-constructed female connector housing is fitted into an orifice formed in a panel constituting a vehicle or the like.

In order to complete the above-mentioned electrical connector assembly, the male connector housing is firstly inserted into the hood and the ring is then rotated to screw the studs into the threads. Consequently, the male connector is engaged with the female connector, while terminals carried in the male connector are electrically connected with terminals in the female connector, respectively.

In the above-mentioned arrangement of the electrical connector assembly, however, there is a problem of difficulty for a worker to confirm the rotating condition of the ring by his sense of sight or touch. For this, there is a possibility of occurrence of imperfect engagement of the male connector with the female connector.

SUMMARY OF THE INVENTION

Under such a circumstance, it is therefore an object of the present invention to provide a mechanism for ascertaining a fitting condition of an electrical connector assembly where a male connector is engaged with a female connector through the intermediary of a rotatable ring. That is, it is an object of the present invention to provide the mechanism which allows a worker to ascertain the fitting condition of the electrical connector assembly with ease and which is capable of engaging the male connector with the female connector certainly and perfectly.

The object of the present invention described above can be accomplished by a mechanism for ascertaining the fitting condition of the electrical connector assembly where the cylindrical male and female connectors are fitted to each other through the rotatable ring, the mechanism comprising:

a detection tool consisting of a rectangular body part, an engagement projection part formed on one side wall of the body part, and a strut part formed on respective end surfaces of the body part and the engagement projection part successively, providing a T-shaped cross section of the detection tool;

an accommodating part formed on an outer peripheral wall of a connector housing of either the male connector or the female connector, the accommodating part having a large groove for receiving the body part of the detection tool and a small groove formed on a bottom of the large groove, for receiving the strut part of the detection tool; and engagement recesses for engagement with the engagement projection part, the engagement recesses being formed on an outer peripheral wall of the ring and provided by partially cutting away the outer peripheral wall from its outer margin on the connector housing's side;

wherein the connector housing is formed so as to accommodate the detection tool slidably.

With the rotation of the rotatable ring, when one of the engagement recess is brought into a position opposing the engagement projection part, the detection tool can be slid in the accommodating part, so that the engagement projection part engages with the engagement recess. Consequently, in case that the engagement projection part can be fitted into the engagement recess after finishing to rotate the ring, it can be realized a condition where the male and female connectors are fitted perfectly. On the contrary, when the engagement projection part is not fitted into the engagement recess, the perfect fitting condition of the male and female connectors cannot be realized.

In the present invention, preferably, the engagement recesses are formed corresponding to starting and end points of a rotational movement of the ring, respectively. In such a case, owing to the positioning of the engagement recesses, the engagement projection part are not engaged with either of the engagement recesses during the rotating of the ring. Therefore, when the engagement projection part is not fitted into the engagement recess, the perfect fitting condition of the connectors cannot be realized.

Preferably, the detection tool is provided, on both side walls of the strut part and on the side of the ring, with engagement projections which extend in a direction crossing an inserting direction of the detection tool into the accommodating part, while the connector housing is provided, on both side walls defining the small groove and on the opposite side of the ring, with hook parts for respective engagement with the engagement projections. Owing to the engagement of the engagement projections of the detection tool with the hook parts of the connector housing, even if the detection tool is moved to the opposite direction to the inserting direction, it is possible to prevent the detection tool from being detached from the accommodating part.

More preferably, the detection tool is provided, on both side walls of the body part and on the opposite side of the ring, with flexible locking parts, while the connector housing is provided, on both side walls defining the large groove and on the opposite side of the ring, with locking engagement parts for respective engagement with the flexible locking parts. According to the arrangement, the engagement state between the engagement projection and the engagement recess can be realized at the same time that the locking parts engage with the locking engagement parts, respectively. Therefore, if the engagement projection is not engaged with the engagement recess, the locking parts and the locking engagement parts cannot be engaged with each other.

Alternatively, it is preferable that the detection tool includes:

engagement projections which are formed on both side walls of the strut part and arranged on the side of the rotatable ring so as to extend in a direction crossing an inserting direction of the detection tool into the accommodating part; and flexible locking parts which are formed on both side walls of the body part and arranged on the opposite side of the rotatable ring; and wherein the connector housing includes:

hook parts which are formed in the accommodating part on both side walls defining the small groove and arranged on the opposite side of the rotatable ring for respective engagement with the engagement projections; and locking engagement parts which are formed on both side walls defining the large groove and arranged on the opposite side of the rotatable ring for respective engagement with the flexible locking parts.

In this case, owing to the engagement of the engagement projections with the hook parts, the detection tool is not detached from the accommodating part. Similarly, by the engagement of the locking parts with the locking engagement parts, the engagement projection is engaged with the engagement recess.

Preferably, the detection tool is provided, on both side walls of the body part, with substantial U-shaped notches which oppose to each other. Under condition that the locking parts are engaged with the locking engagement parts and during the rotation of the rotatable ring, the engagement projection is accommodated in the accommodating part due to the provision of the notches. Note, after rotating the ring, the engagement projection is urged into the engagement recess. Therefore, after the rotation of the ring is finished, then the engagement projection and recess can be brought into their engagement condition automatically.

More preferably, each of the notches has a width in an inserting direction of the detection tool into the accommodating part, larger than a projecting length of the engagement projection part from the body part. With the establishment, under condition that the locking parts are engaged with the locking engagement parts and during the rotation of the rotatable ring, the engagement projection part of the detection tool can be accommodated in the accommodating part.

These and other objects and features of the present invention will become more fully apparent from the following description and appended claims taken in conjunction with the accompany drawing.

BRIEF DESCRIPTION OF THE DRAWINGS

FIGS. 4A and 4B show a condition before rotating an engagement ring as a constituent of the mechanism of FIG. 1, in which FIG. 4A is a perspective view of the condition and FIG. 4B is a plan view of the condition;

FIGS. 5A and 5B show a condition in process of rotating the engagement ring, in which FIG. 5A is a perspective view of the condition and FIG. 5B is a plan view of the condition;

FIGS. 6A and 6B show a condition after rotating the engagement ring, in which FIG. 6A is a perspective view of the condition and FIG. 6B is a plan view of the condition;

DESCRIPTION OF THE PREFERRED EMBODIMENT

FIGS. 1 to 12 show a mechanism for ascertaining the engagement condition of the electrical connector, in accordance with a first embodiment of the present invention.

Figure 1:
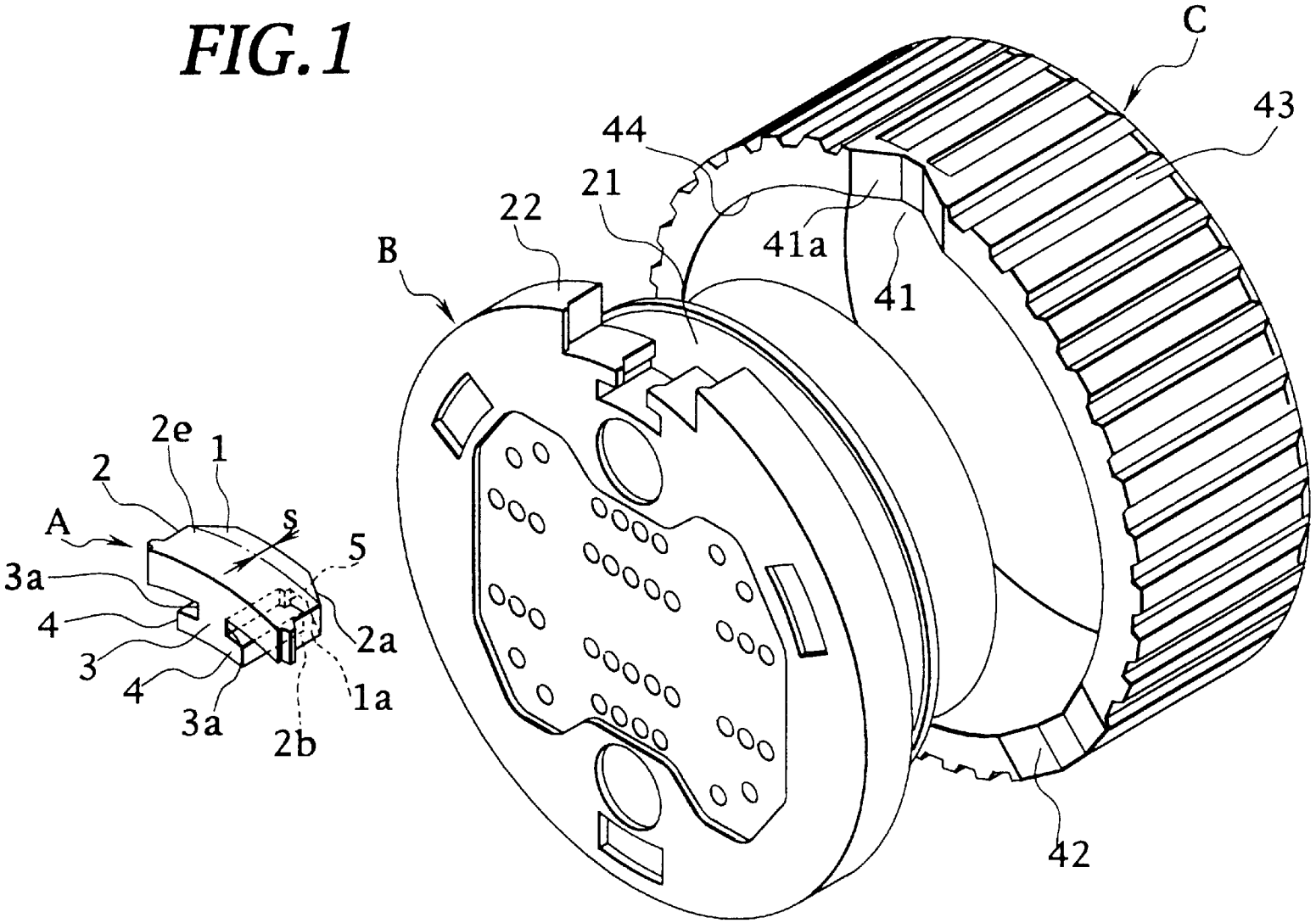
FIG. 1 is a perspective view of an engagement ascertaining mechanism for an electrical connector assembly, in accordance with a first embodiment of the present invention.

In FIG. 1, the engagement ascertaining mechanism is constituted by a detection tool A, an accommodating part 21 for receiving the detection tool A and an engagement recess 41. Being formed to have a T-shaped cross section, the detection tool A is provided with an engagement projection part 1. The accommodating part 21 is formed on a cylindrical male connector housing B, while the engagement recess 41 is formed on a rotatable ring C.

Figure 2:
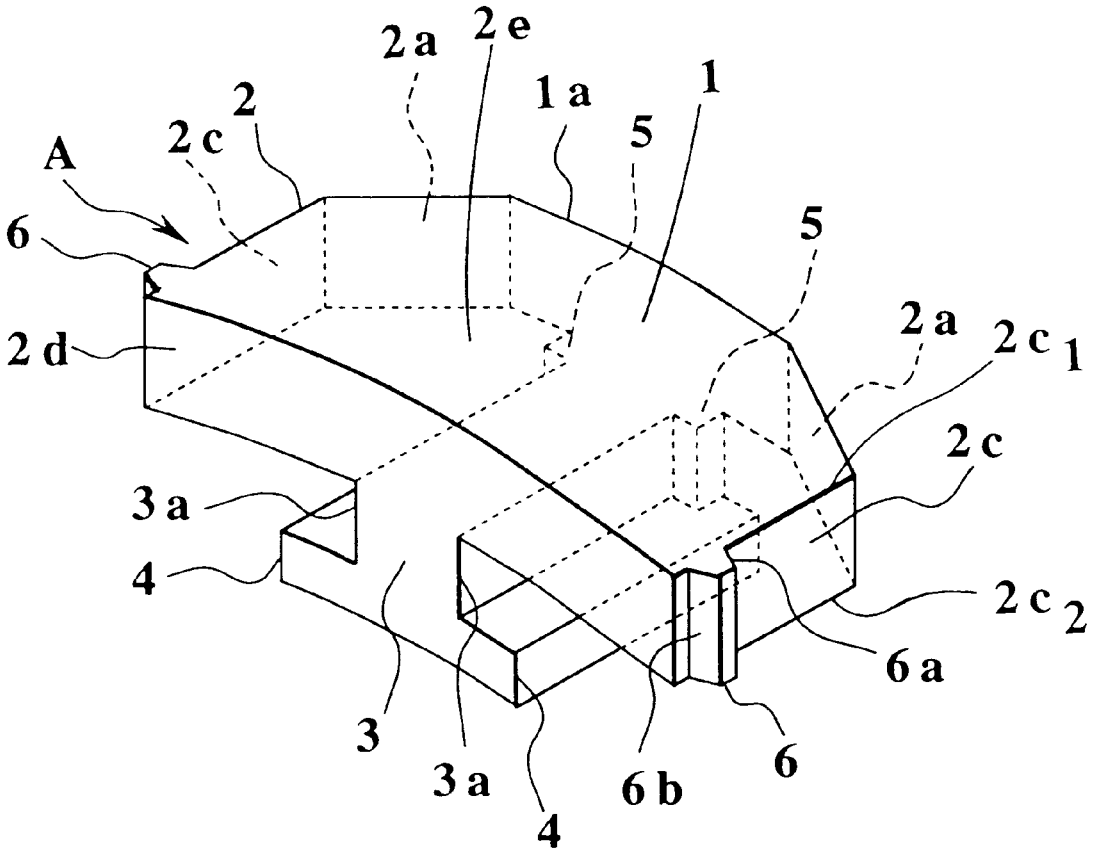
FIG. 2 is an enlarged perspective view of a detection tool as a constituent of the mechanism of FIG. 1.

As shown in FIG. 2, the detection tool A includes a rectangular body part 2, the above engagement projection part 1 formed on a front wall 2*a* of the body part 2, and a strut part 3 carrying the engagement projection 1 and the body part 2 and having a pair of guide parts 4, 4 formed at a lower end thereof.

The engagement projection part 1 is formed so as to swell from the whole surface of the front wall 2*a* and project therefrom at a desired projecting length s. The strut part 3 is formed in a manner that an upper end thereof crosses a lower wall 2*b* of the body part 2 and reaches an end 1*a* of the engagement projection part 1. The pair of guide parts 4, 4 on both side walls 3*a*, 3*a* of the strut part 3 are formed in substantial parallel with the body part 2. Further, the cross section of the body part 2 is curved so that, on condition that the detection tool A is inserted into the accommodating part 21, an outer peripheral wall 22 of the connector housing B connect with an upper wall 2*e* of the body part 2 smoothly.

On both of the side walls 3*a*, 3*a*, engagement projections 5, 5 are formed to project in a direction perpendicular to an inserting direction of the detection tool A into the accommodating part 21. On each side wall 3*a*, the engagement projection 5 is arranged on the side of the end 1*a* of the engagement projection part 1 so as to extend between the engagement projection part 1 and the guide part 4.

Similarly, on both side walls 2*c*, 2*c* of the body part 2 in parallel with the side walls 3*a*, 3*a* of the strut part 3, a pair of flexible locking parts 6, 6 are provided in the direction perpendicular to the inserting direction of the detection tool A into the accommodating part 21. On each side wall 2*c*, the locking part 6 is arranged on the side of a rear wall 2*d* of the body part 2 so as to extend between an upper edge $2c_1$ and a lower edge $2c_2$ of the side wall 2*c* vertically. Further, the locking part 6 is provided, on front and rear walls thereof, with tapered surfaces 6*a* and 6*b*, respectively.

Figure 3:
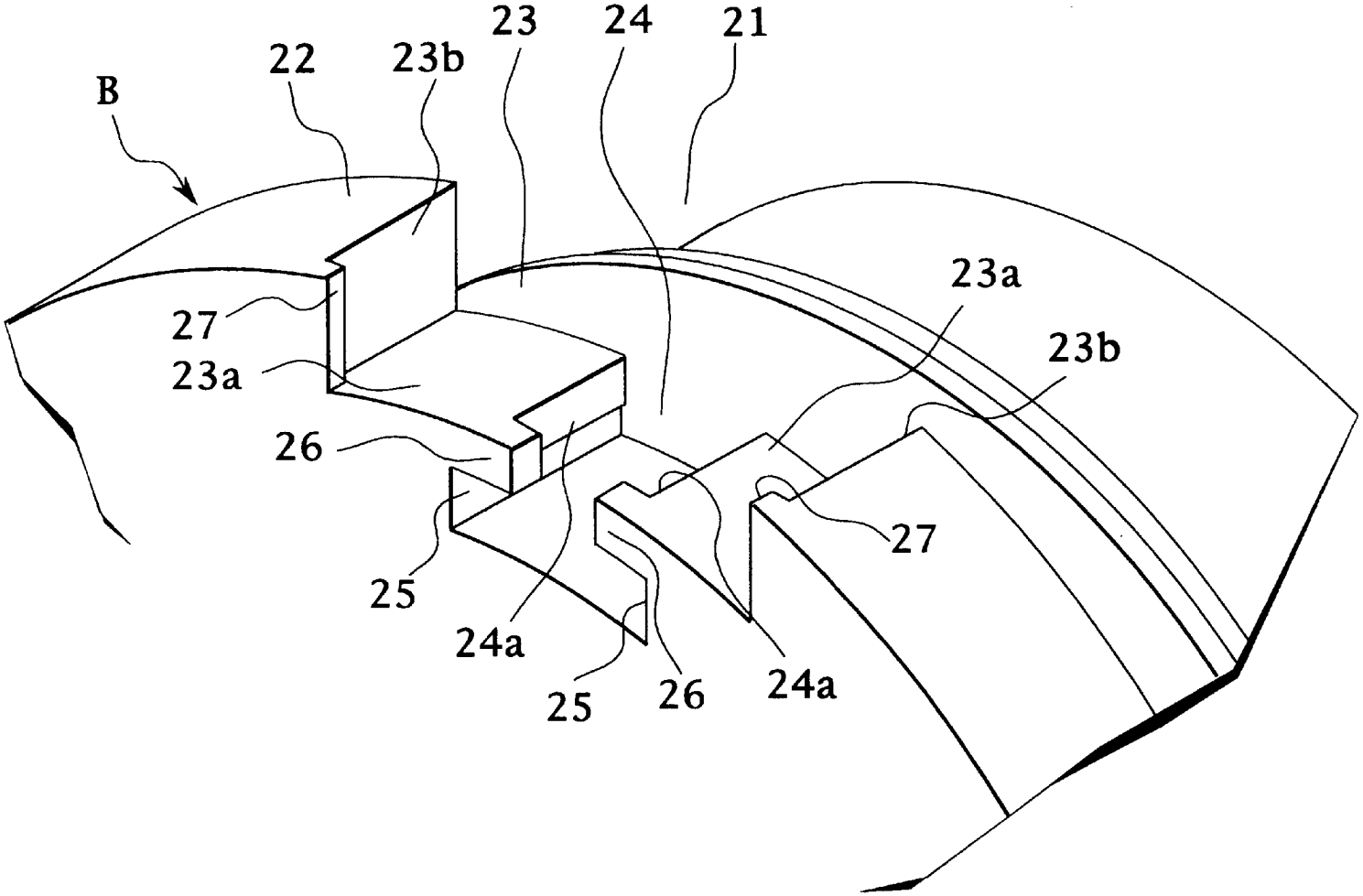
FIG. 3 is an enlarged perspective view of an accommodating part as a constituent of the mechanism of FIG. 1.

As shown in FIG. 3, the accommodating part 21 comprises a large groove 23 formed on the outer peripheral wall 22 of the connector housing B to receive the body part 2, and a small groove 24 formed on a bottom wall 23*a* of the groove 23 to accommodate the strut part 3 therein. Further, the small groove 24 is provided, on both side walls 24*a*, 24*a* thereof, with guide grooves 25, 25 for guiding the guide parts 4, 4 of the detection tool A.

Rectangularly formed on both side walls 24*a*, 24*a* of the small groove 24 are a pair of flexible hook parts 26, 26 which project to each other in the vicinity of respective rear ends of the side wall 24*a*, 24*a*. Note, it is preferable that the rear ends of the hook parts 26, 26 are tapered while the front ends are formed to be plane.

The large groove 23 is provided, on both side walls 23*b*, 23*b* thereof, with locking engagement parts 27, 27. The locking engagement parts 27, 27 are arranged so as to extend between the outer peripheral wall 22 and the bottom wall 23*a* and oppose to each other at respective rear ends of the side walls 23*b*, 23*b*.

In addition to the engagement recess 41, the ring C further includes another engagement recess 42 formed on the outer peripheral wall 43, as shown in FIG. 1. In detail, on the outer peripheral wall 43 of the ring C, the engagement recess 41 is positioned so that, in the rotating operation of the ring C on the connector housing B, the accommodating part 21 of the connector housing B faces the engagement recess 41 of the ring C before being rotated, while the engagement recess 42 is arranged so that the accommodating part 21 of the connector housing B faces the engagement recess 42 of the ring C after being rotated.

Figure 4A:
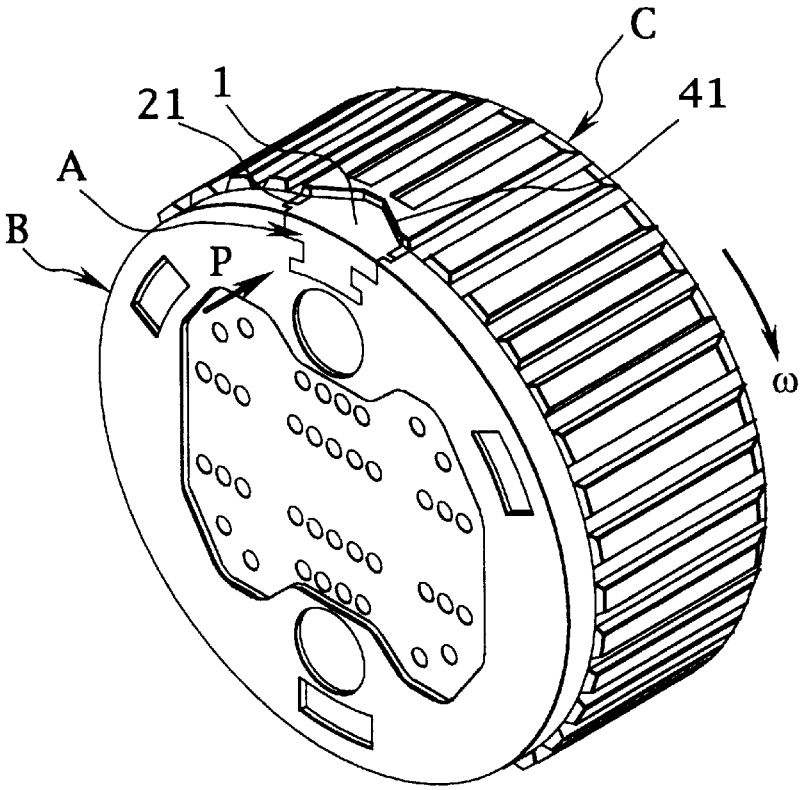
Figure 4B:
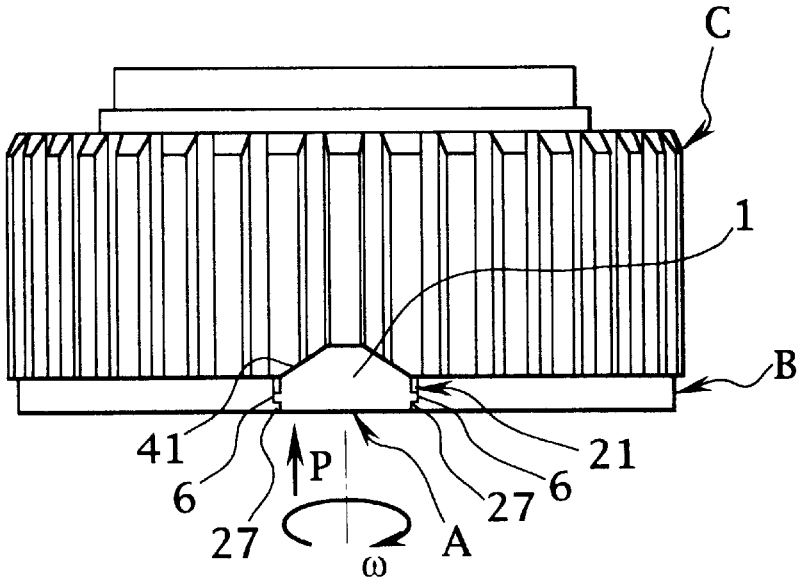
Figure 5A:
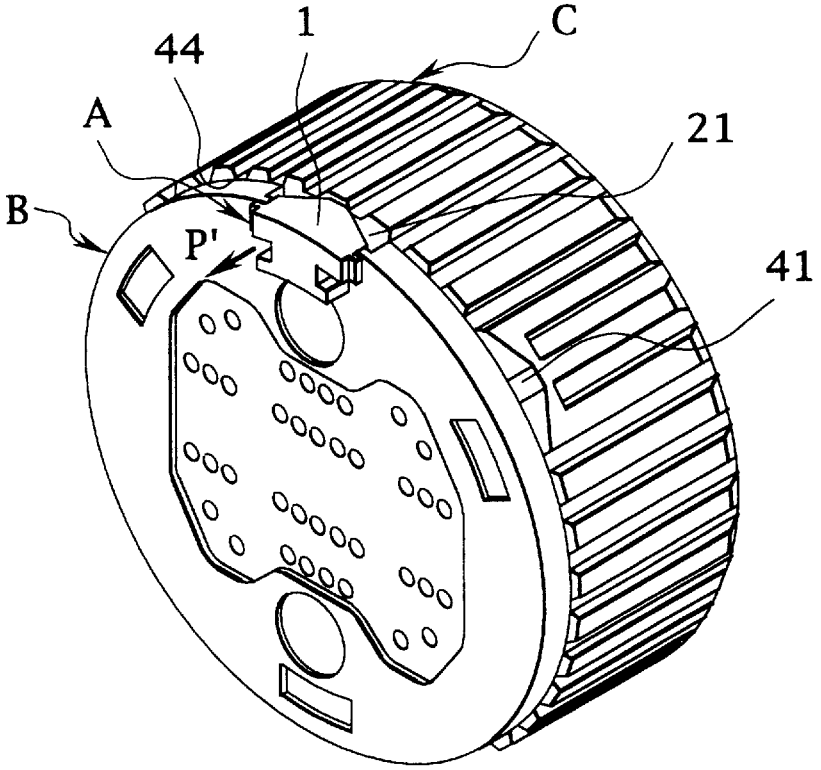
Figure 5B:
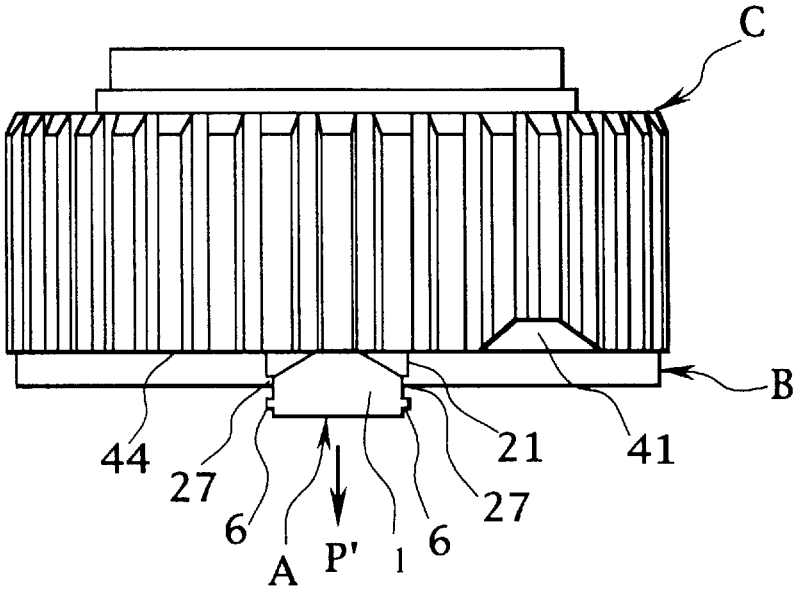

Again, as shown in FIGS. 4A and 4B, the ring C is rotatably mounted on the connector housing B. While the ring C is not rotated yet, the detection tool A is inserted into the accommodating part 21 of the connector housing B. Then, with the insertion of the tool A in the direction of P, the engagement projections 5, 5 bend the hook parts 26, 26. Subsequently, with the entering of the guide parts 4, 4 into the guide grooves 25, 25, the locking parts 6, 6 surmount the hook parts 26, 26. In this way, the engagement projection part 1 is engaged into the engagement recess 41, while the locking parts 6, 6 are engaged with the locking engagement parts 27, 27.

Under the above-mentioned condition and when rotating the ring C in the direction of ω, the engagement projection part 1 is urged to shift to the direction of P' by an outer margin 44 of the ring C, so that the engagement of the engagement projection 1 into the engagement recess 41 is released. With the releasing, the engagement of the locking parts 6, 6 with the locking engagement parts 27, 27 is released, too. Nevertheless, since the engagement of the engagement projections 5, 5 with the hook parts 26, 26 is not still released, the detection tool A is not detached from the connector housing B. That is, under condition that the fitting of the engagement projection part 1 to the engagement recess 41 and the engagement of the locking parts 6, 6 with the locking engagement parts 27, 27 are released, if the ring C is rotated in the direction of ω, it is caused either one of conditions where the engagement projection part 1 comes into contact with the outer peripheral margin 44 and where a clearance is produced between the projection part 1 and the margin 44.

Figure 6A:
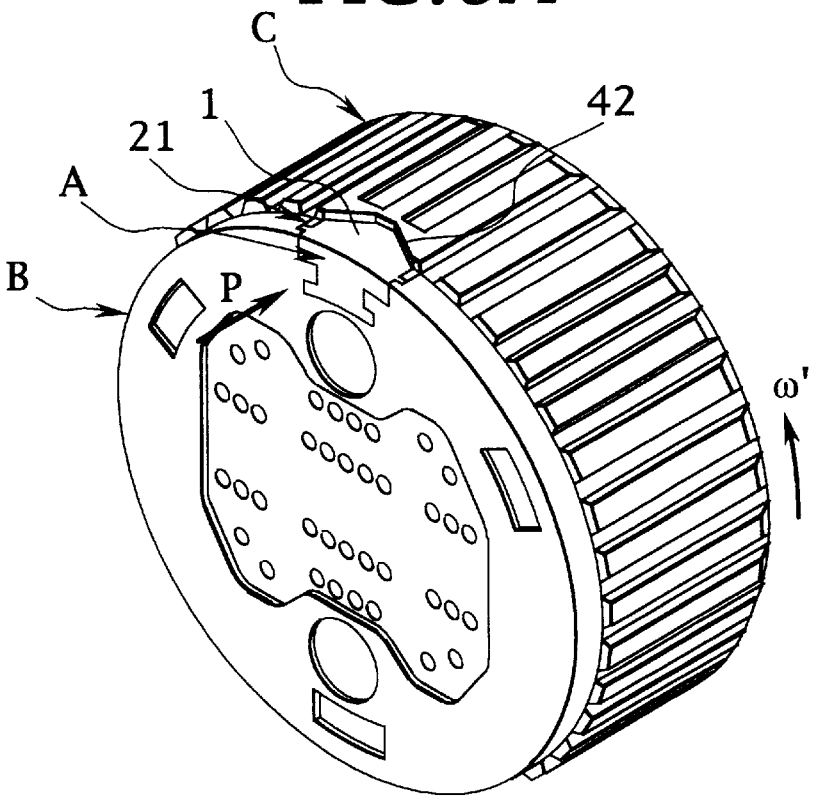
Figure 6B:
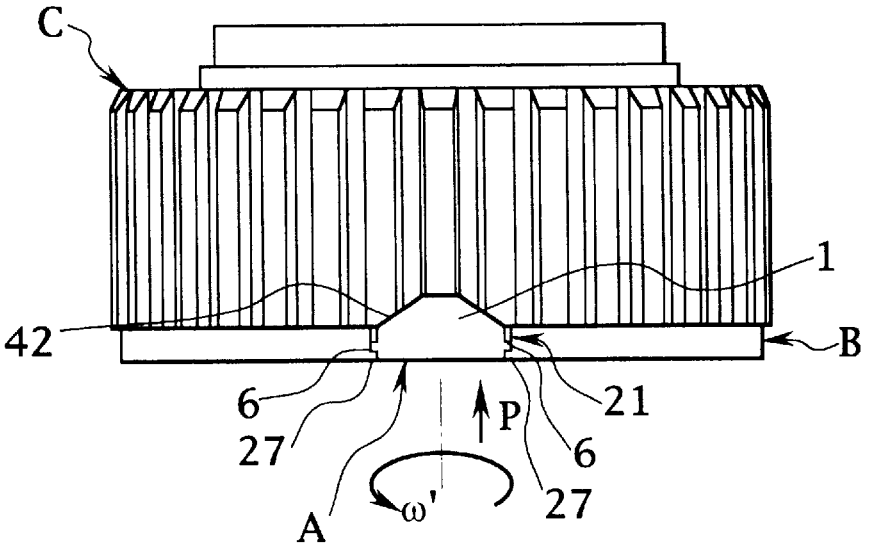

After completing the rotation of the ring C, the engagement recess 42 is brought to a rotating position opposing the engagement projection 1, so that the detection tool A is urged to the direction of P, as shown in FIGS. 6A and 6B. Consequently, the guide part 4 of the detection tool A is slid along the guide groove 25, so that the locking part 6 engages with the locking engagement part 27. Therefore, it is noted that if the rotation of the ring C is not completed, the engagement recess 42 does not reach the above-mentioned position opposing the engagement projection part 1. Thus, even if the engagement projection part 1 is urged to the direction of P, the engagement projection part 1 is not fitted into the engagement recess 42.

Figure 7:
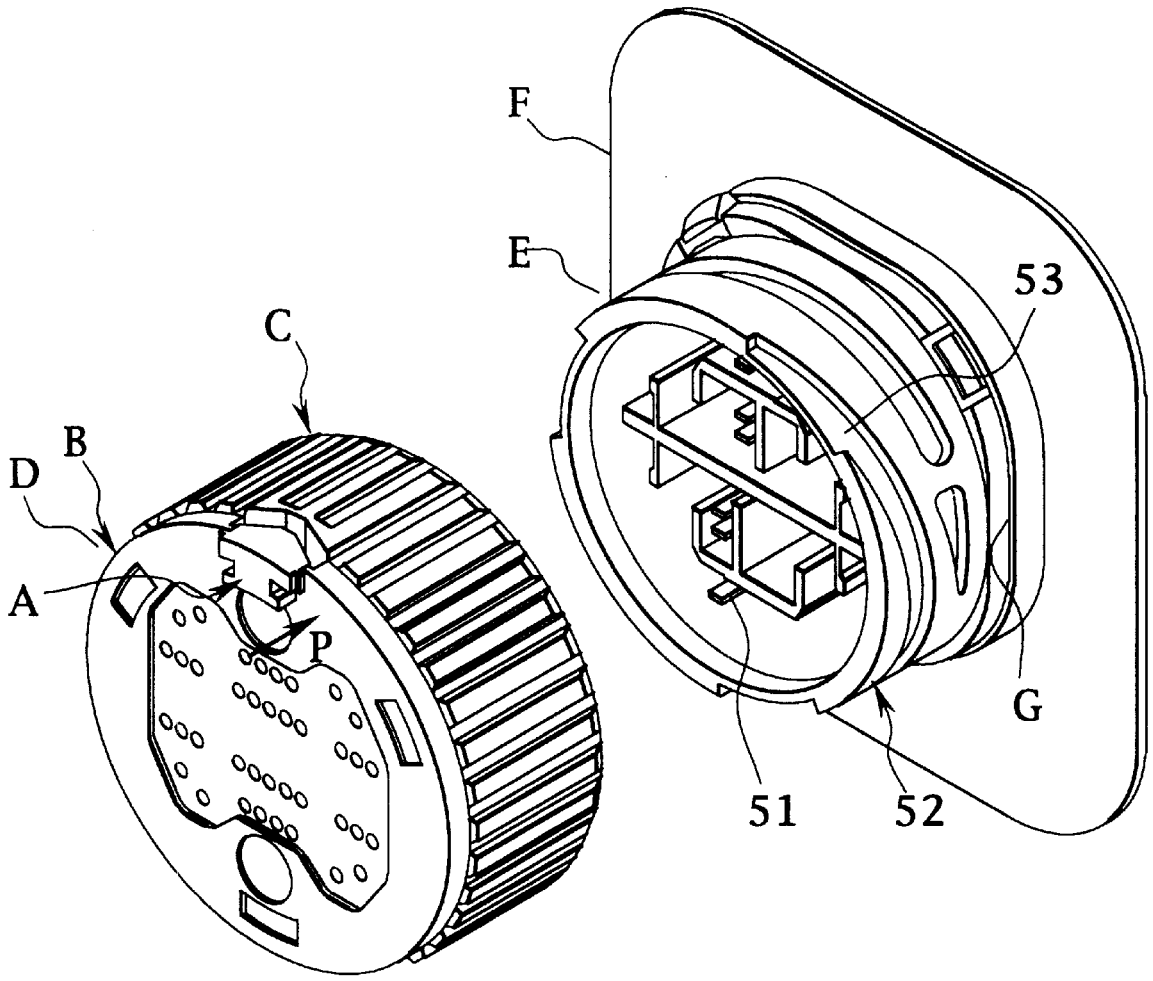
FIG. 7 is an explanatory view of an operation to engage a male connector with a female connector, showing a condition before the male connector is inserted into a hood of the female connector.

Next, referring to FIG. 7, we describe the engagement operation between the male connector D where the ring C is rotatably mounted on the connector housing B while using the detection tool A, and a female connector E. As shown in FIG. 7, the female connector E having male terminals 51 (FIG. 11) therein is provided with a hood 52 for receiving the male connector D having female terminals 31 (FIG. 11) and fitted into an orifice G formed in a panel F of an vehicle or the like. The detection tool A is inserted into the accommodating part 21 of the connector housing B of the male connector D, so that the engagement projection part 1 is fitted into the engagement recess 41.

Figure 8:
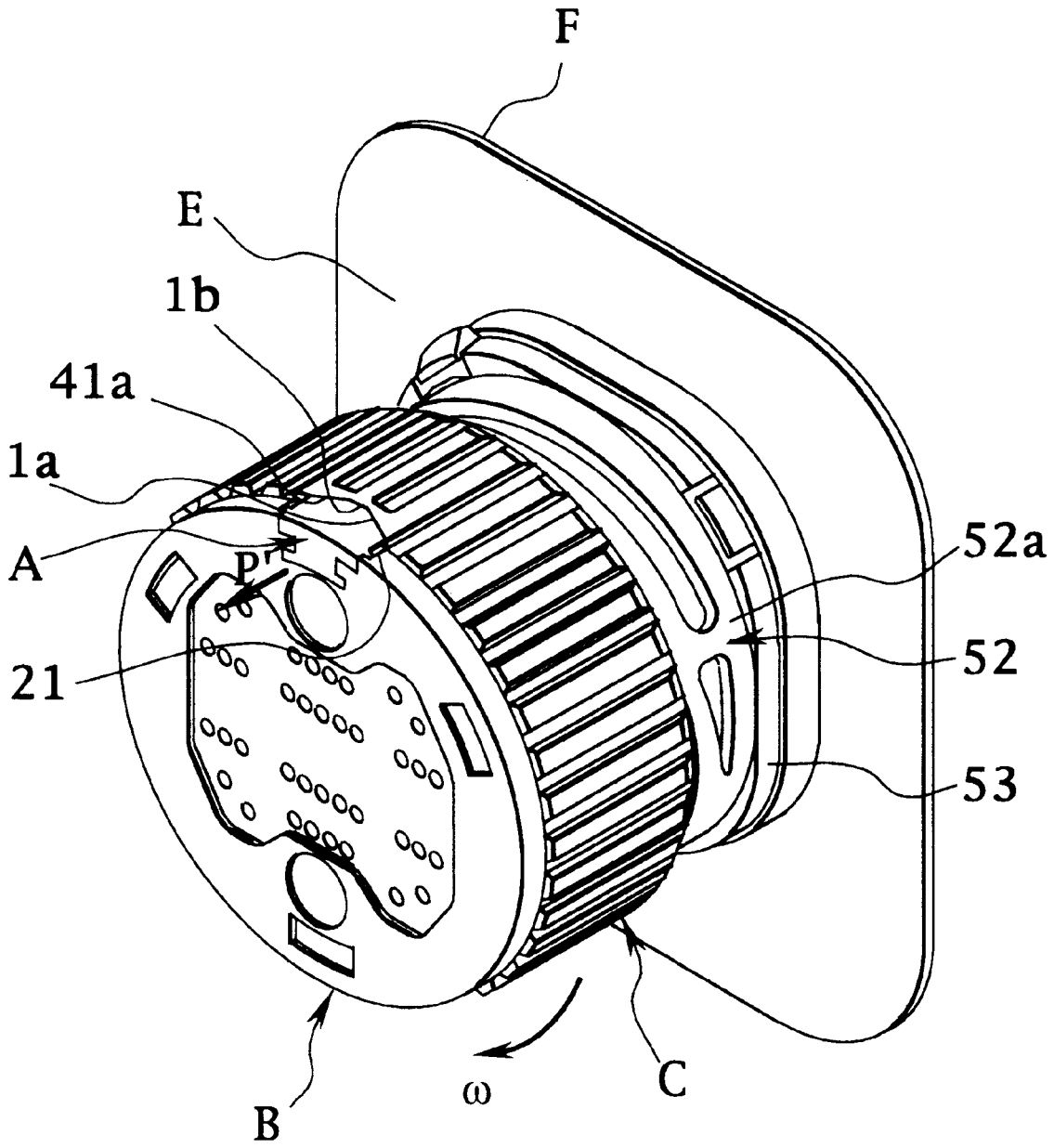
FIG. 8 is a perspective view showing a condition after the male connector is inserted into the hood of the female connector and before the engagement ring is rotated.

As shown in FIG. 8, when the ring C is put on the hood 52 and rotated in the direction of ω, the not-shown threads formed in the inner face of the ring C engages with thread grooves 53 formed on an outer face 52*a* of the hood 52. Due to the rotation of the ring C in the direction of ω, the engagement recess 41 operates to press the engagement projection part 1. In detail, a tapered inner wall 41*a* of the engagement recess 41 urges a tapered outer wall 1*a* of the engagement projection part 1. Consequently, with the rotation of the ring C, the engagement of the locking part 6 with the locking engagement part 27 is released to shift the detection tool A to the direction of P', while the fitting of the engagement projection part 1 into the engagement recess 41 is also released.

Figure 9:
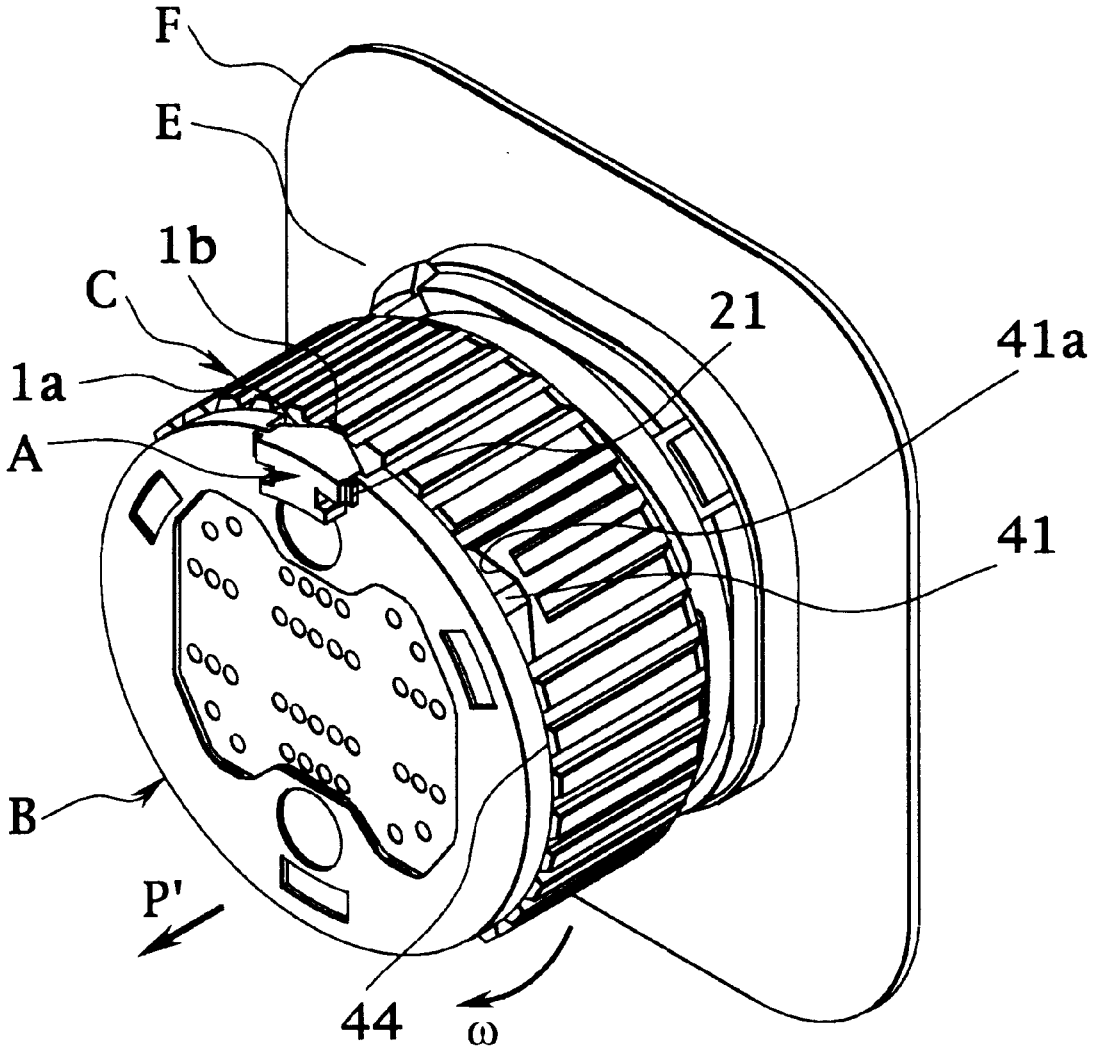
FIG. 9 is a perspective view showing a condition in process of rotating the engagement ring.

During the rotation of the ring C, as shown in FIG. 9, the outer margin 44 of the ring C frictionally moves on the projecting wall 1*b* of the engagement projection part 1. Alternatively, the ring C is rotated while the clearance is produced between the margin 44 and the wall 1*b*. Even if the detection tool A is moved by the engagement projection 5 and the engagement part 26, the tool A is not detached from the accommodating part 21.

Figure 10:
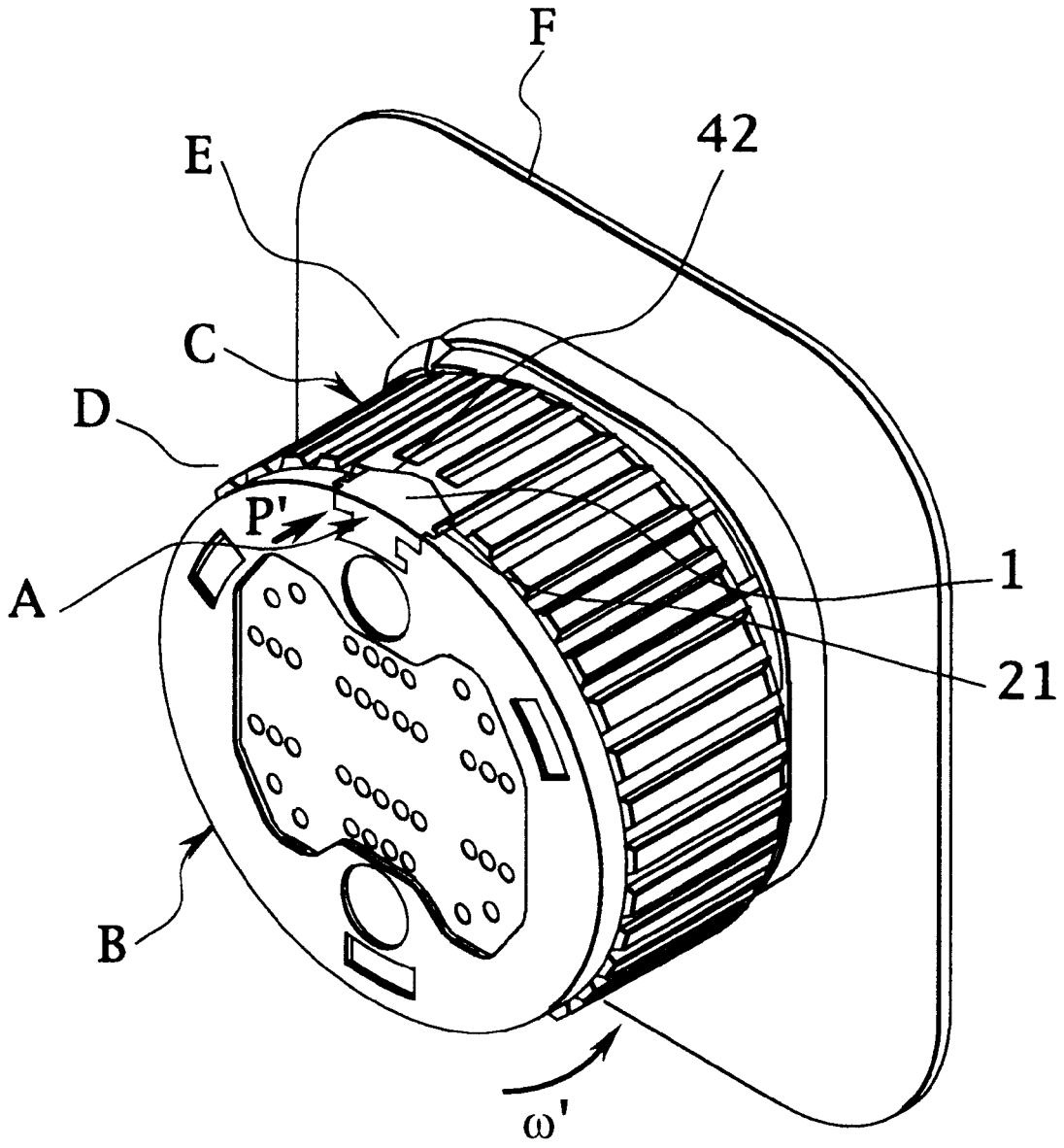
FIG. 10 is a perspective view showing a condition after finishing to rotate the engagement ring.
Figure 11:
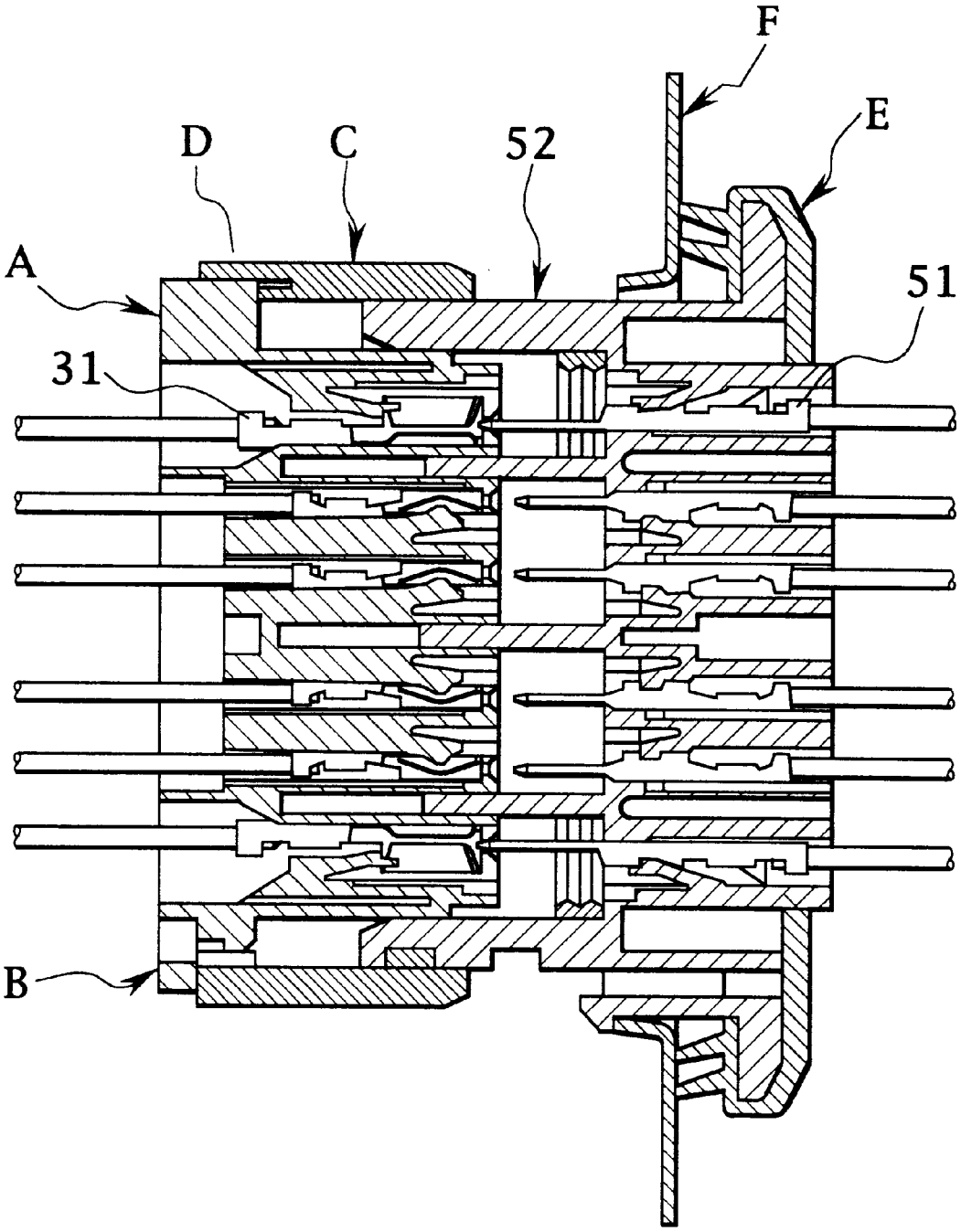
FIG. 11 is a longitudinal cross sectional view showing a condition before rotating the engagement ring.
Figure 12:
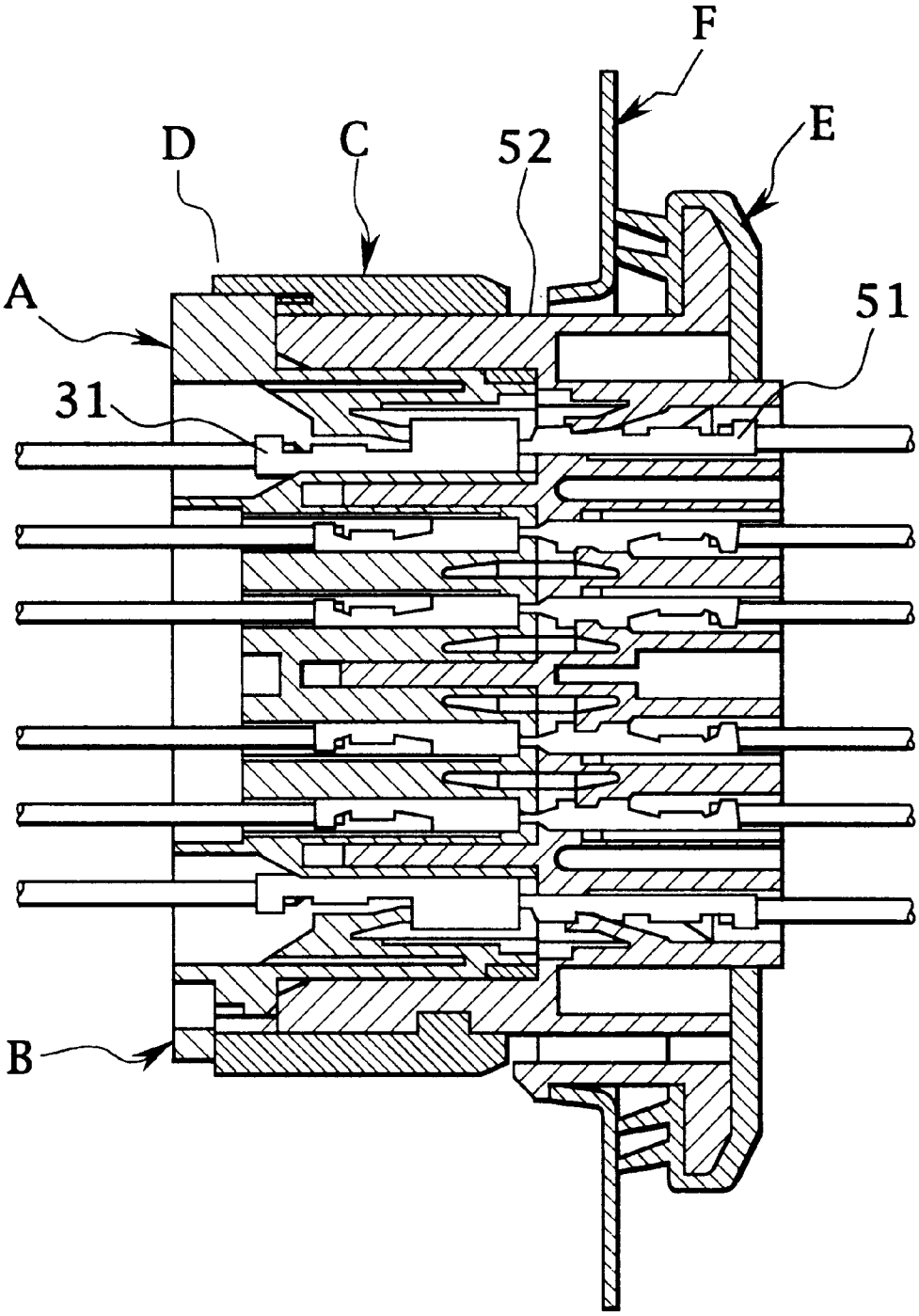
FIG. 12 is a longitudinal cross sectional view showing a condition after rotating the engagement ring.

When the screw threads mesh with the thread grooves 53 as shown in FIG. 10, the rotation of ring C is finished. Then, the engagement recess 42 is brought into the position opposing the engagement projection 1. Under such a situation, when pressing the detection tool A in the direction of P, the locking part 6 is engaged with the locking engagement part 26, while the engagement projection part 1 is fitted into the engagement recess 42. This means that the male connector D is fitted into the female connector E while the male terminals 51 are electrically connected with the female terminals 31, as shown in FIG. 12. Note, in order to disengage the male connector D from the female connector E, the ring C may be rotated in the direction of ω'.

This is, during the rotation of the ring C, the detection tool A is moved to the direction of P', so that the engagement projection part 1 is not engaged into either the engagement recess 41 or the recess 42. Accordingly, under such a condition, the male connector D cannot be fitted into the female connector E. On the contrary, after the ring has been rotated, since the engagement projection part 1 is fitted into the engagement recess 42, the male connector D can be fitted into the female connector E. Consequently, since the engagement projection part 1 is fitted into the engagement recess 42, it is possible to confirm the engagement condition between the male connector D and the female connector E. Whether the engagement projection part 1 is fitted into the engagement recess 42, it is possible for a worker to ascertain whether the male connector D and the female connector E are in the engagement condition easily and certainly.

Figure 13:
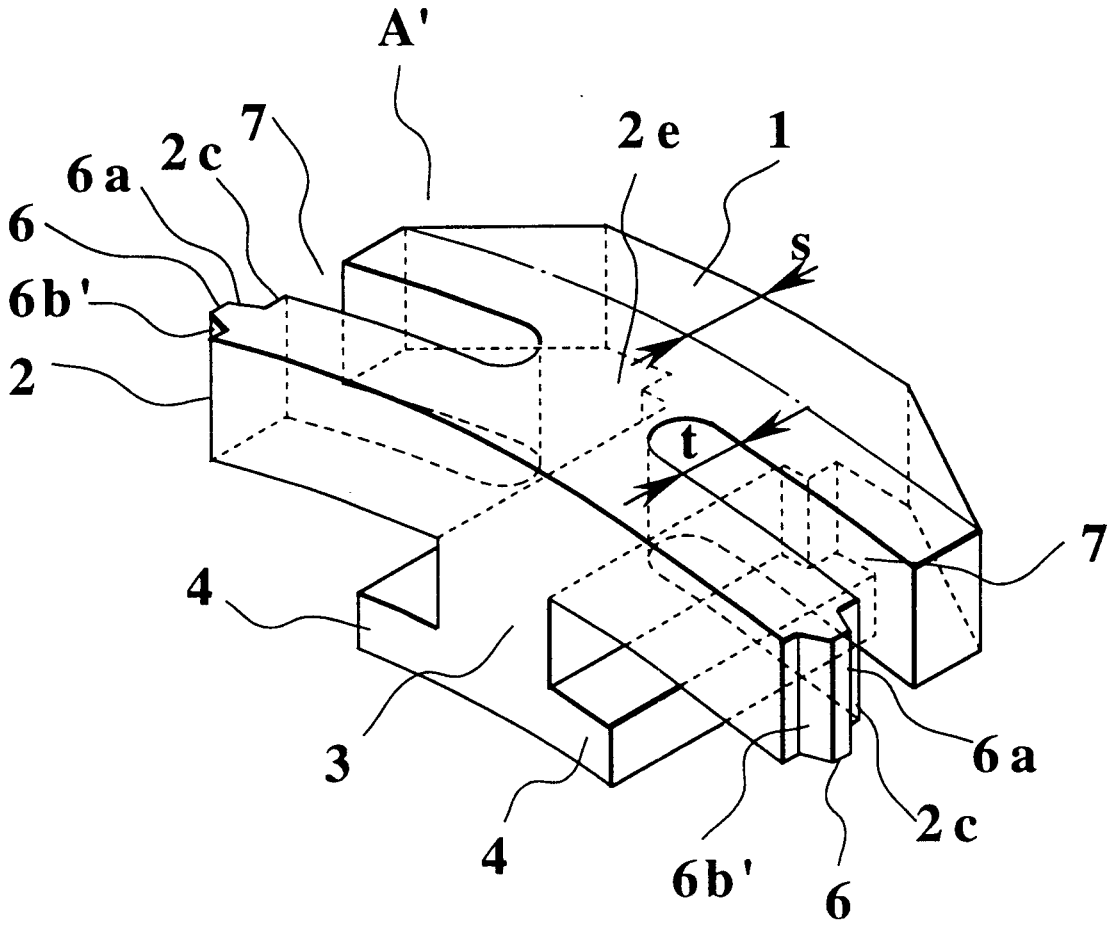
FIG. 13 is an enlarged perspective view of the detection tool as the constituent of the engagement ascertaining mechanism for the electrical connector assembly, in accordance with a second embodiment of the present invention.
Figure 14:
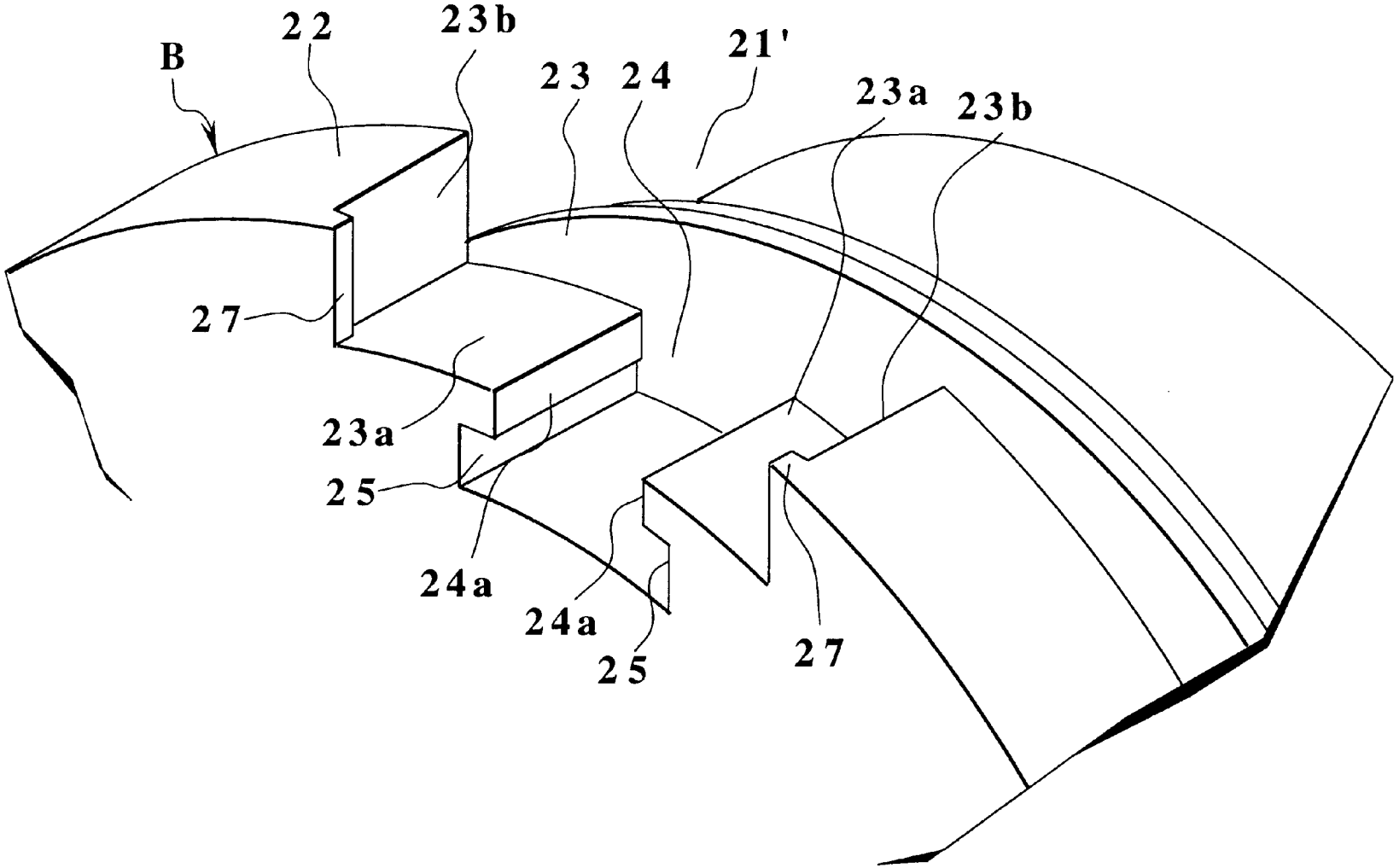
FIG. 14 is an enlarged perspective view of the accommodating part as the constituent of the engagement ascertaining mechanism of FIG. 13.
Figure 15A:
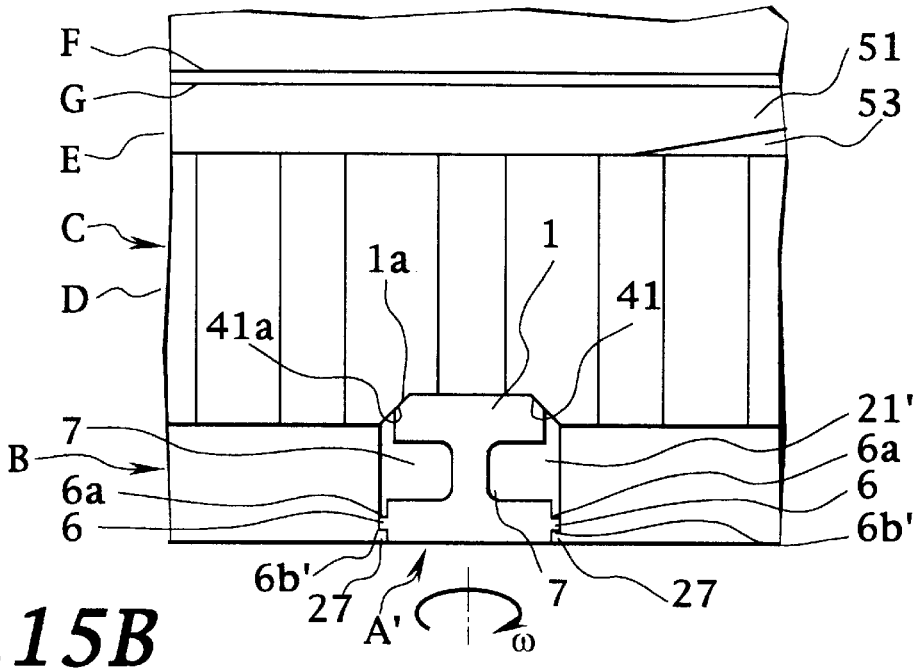
FIG. 15A is a plan view showing a condition before rotating the engagement ring of the engagement ascertaining mechanism of FIG. 13.

FIGS. 13 to 15 shows the second embodiment of the mechanism of the present invention. Note, in the embodiment, elements similar to those of the first embodiment are indicated with the same reference numerals, respectively and overlapping descriptions thereof are eliminated, accordingly.

In FIG. 13, the detection tool A' includes the body part 2 and the strut part 3. The body part 2 has the engagement projection part 1 formed to swell forward. While, the strut part 3 is provided with the pair of guide parts 4, 4. According to the embodiment, the body part 2 is provided, on both side walls 2*c*, 2*c* thereof, with notches 7, 7. The locking parts 6, 6 projecting from both side walls 2*c*, 2*c* of the body part 2 include the tapered faces 6*a*, 6*a* on the front side in the inserting direction of the tool A and vertical faces 6*b*', 6*b*' on the rear side.

The notches 7, 7 are formed on the side walls 2*c*, 2*c* so as to oppose each other. The width (clearance) t of each notch 2 is established to be larger than the projecting length s of the engagement projection 1, i.e. a relationship of t>s. Owing to the provision of the notches 7, 7 in the body part 2, the engagement projection part 1 is adapted so as to incline to right and left as a center of an intermediate portion 2*e* between the notches 7, 7. In other words, the projection part 1 is capable of swinging like a seesaw. Note, in the modification, the intermediate portion 2*e* may be provided with flexibility.

As shown in FIG. 14, an accommodating part 21' is composed of the large groove 23 which is formed on the outer wall 22 of the connector housing 22 and the small groove 24 which is formed in the large groove 23 and provided, on both side walls 24*a*, 24*a*, with the guide grooves 25, 25. On the other hand, the large groove 23 has the locking engagement parts 27, 27 formed on the side walls 23*b*, 23*b*.

Next, we describe the fitting operation of the male connector D where the ring C is rotatably mounted on the connector housing B, into the female connector E by means of the detection tool A'.

Under condition that the ring C is not rotated yet, the locking parts 6, 6 of the detection tool A' are engaged with the locking engagement parts 27, 27 of the accommodating part 21' respectively, while that the engagement projection part 1 is engaged with the engagement recess 41.

Figure 15B:
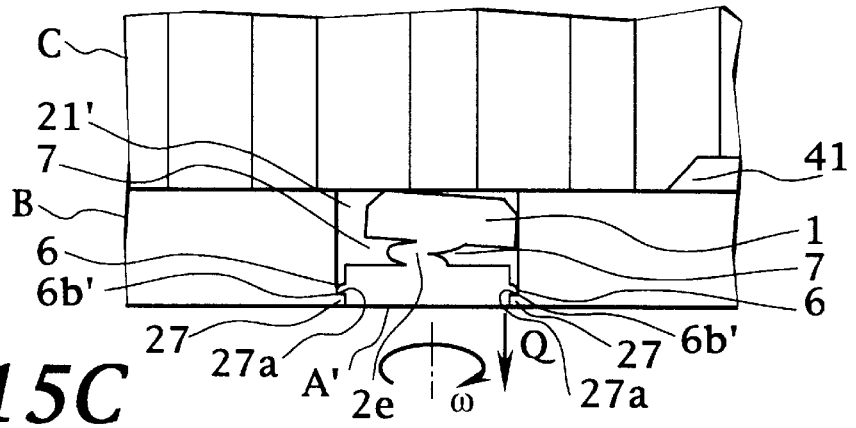
FIG. 15B is a plan view showing a condition in process of rotating the engagement ring of the engagement ascertaining mechanism of FIG. 13.

Just after starting to rotate the ring C, as shown in FIG. 15B, the outer wall 1*a* of the engagement projection 1 is urged by the inner wall 41*a* of the engagement recess 41. With the rotation of the ring C, the engagement projection part 1 begins to incline to the right side. Under such a condition, since the vertical face 6*b*' of each locking part 6 is engaged with the vertical face 27*a* of the locking engagement part 27, the detection tool A' does not move in a direction of Q, i.e. the direction opposite to the inserting direction of the tool A' into the accommodating part 21'.

During the rotation of the ring C, as shown in FIG. 15B, the engagement projection part 1 is inclined to the right side, while the intermediate portion 21*e* is slightly inclined to the same side. Consequently, the engagement projection part 1 is depressed into the accommodating part 21' by force. In this way, according to the embodiment, the ring C is rotated while maintaining the outer wall of the engagement projection part 1 to be abutted on the outer wall 43 of the ring C frictionally.

Figure 15C:
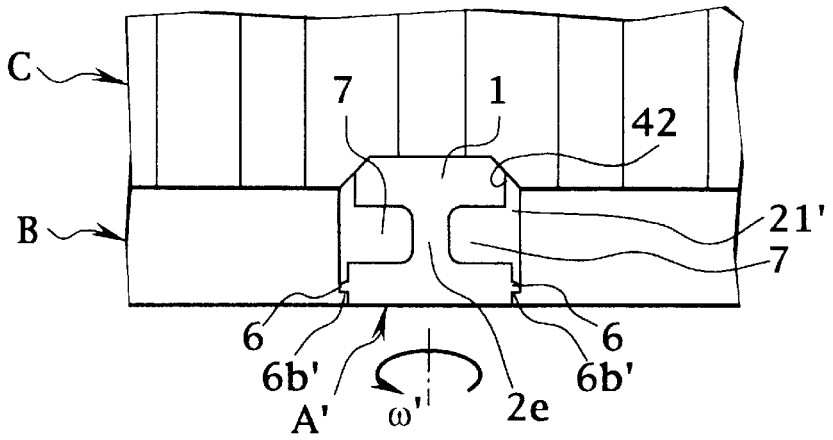
FIG. 15C is a plan view showing a condition after rotating the engagement ring of the engagement ascertaining mechanism of FIG. 13.

At the end of rotating of the ring C, as shown in FIG. 15C, the engagement recess 42 is moved to the position opposing the engagement projection part 1. With the movement, the engagement projection part 1 inclining to the right side is urged toward the engagement recess 42, so that the projection part 1 automatically returns to its original configuration before the ring C has been rotated. Then, the engagement projection part 1 is fitted into the engagement recess 42.

In this way, depending on whether the engagement projection part 1 can be fitted into the engagement recess 42 at the end of the rotating movement of the ring C, it is possible to confirm the engagement condition between the male connector D and the female connector E. Note, in order to release the fitting condition between the male connector D and the female connector E, the worker has only to rotate the ring C in the direction of ω so that the engagement projection part 1 is fitted into the engagement recess 41 perfectly.

Finally, it will be understood by those skilled in the art that the foregoing description is related to some preferred embodiments of the disclosed mechanism, and that various changes and modifications may be made to the present invention without departing from the spirit and scope thereof.

What is claimed is:

1. A mechanism for ascertaining a fitting condition of an electrical connector assembly where cylindrical male and female connectors are fitted to each other through a rotatable ring, said mechanism comprising:

a detection tool consisting of a rectangular body part, an engagement projection part formed on one side wall of said body part, and a strut part formed on respective end surfaces of said body part and said engagement projection part successively, providing a T-shaped cross section of said detection tool;

an accommodating part formed on an outer peripheral wall of a connector housing of either said male connector or said female connector, said accommodating part having a large groove for receiving said body part of said detection tool and a small groove formed on a bottom of said large groove, for receiving said strut part of said detection tool; and engagement recesses for engagement with said engagement projection part, said engagement recess being formed on an outer peripheral wall of said ring and provided by partially cutting away said outer peripheral wall from its outer margin on said connector housing's side;

wherein said connector housing is formed so as to accommodate said detection tool slidably.

2. A mechanism as claimed in claim 1, wherein said engagement recesses are formed corresponding to starting and end points of a rotational movement of said ring, respectively.

3. A mechanism as claimed in claim 1, wherein said detection tool is provided, on both sidewalls of said strut part, with engagement projections which extend in a direction crossing an inserting direction of said detection tool into said accommodating part, while said connector housing is provided, on both sidewalls defining said small groove, with hook parts for respective engagement with said engagement projections.

4. A mechanism as claimed in claim 1, wherein said detection tool includes:

engagement projections which are formed on both sidewalls of said strut part so as to extend in a direction crossing an inserting direction of said detection tool into said accommodating part; and flexible locking parts which are formed on both sidewalls of said body part; and wherein said connector housing includes:

hook parts which are formed in said accommodating part on both sidewalls defining said small groove for respective engagement with said engagement projections; and locking engagement parts which are formed on both sidewalls defining said large groove for respective engagement with said flexible locking parts.

5. A mechanism as claimed in claim 1, wherein said detection tool is provided, on both sidewalls of said body part, with flexible locking parts, while said connector housing is provided, on both sidewalls defining said large groove, with locking engagement parts for respective engagement with said flexible locking parts.

6. A mechanism as claimed in claim 5, wherein said detection tool is provided, on both side walls of said body part, with substantial U-shaped notches which oppose to each other.

7. A mechanism as claimed in claim 6, wherein each of said notches has a width in an inserting direction of said detection tool into said accommodating part, larger than a projecting length of said engagement projection part from said body part.

* * * * *